United States Patent [19]

Luebbers

[11] Patent Number: 4,599,946

[45] Date of Patent: Jul. 15, 1986

[54] IGNITION DEVICE

[75] Inventor: Willi Luebbers, Trittau, Fed. Rep. of Germany

[73] Assignee: Nico-Pyrotechnik Hanns-Juergen Diederichs GmbH & Co., KG., Trittau, Fed. Rep. of Germany

[21] Appl. No.: 570,217

[22] Filed: Jan. 12, 1984

[30] Foreign Application Priority Data

Jan. 12, 1983 [DE] Fed. Rep. of Germany ..... 3300748

[51] Int. Cl.[4] ..... F42C 1/02; F42C 7/00; F42B 23/26

[52] U.S. Cl. ..... 102/274; 102/429

[58] Field of Search ..... 102/204, 273, 274, 253, 102/424, 428, 429

[56] References Cited

U.S. PATENT DOCUMENTS

| | | | |
|---|---|---|---|
| 2,376,332 | 5/1945 | Adelman | 102/429 X |
| 2,935,949 | 5/1960 | Holford | 102/429 X |
| 3,397,635 | 8/1968 | Madlener et al. | 102/274 X |
| 3,638,501 | 2/1972 | Prachar | 102/253 X |
| 3,718,093 | 2/1973 | Milanowski et al. | 102/273 |

FOREIGN PATENT DOCUMENTS

| | | | |
|---|---|---|---|
| 52393 | 8/1974 | Australia | 102/429 |
| 3038942 | 5/1981 | Fed. Rep. of Germany | 102/274 |
| 297057 | 3/1954 | Switzerland | 102/429 |
| 2184 | of 1885 | United Kingdom | 102/274 |
| 765026 | 1/1957 | United Kingdom | 102/429 |

*Primary Examiner*—David H. Brown

[57] ABSTRACT

An ignition device for mines, in particular training mines. The device includes a percussion bolt which is mechanically held in an inoperative position and is loaded by the action of a coil spring so that when released it is propelled axially towards a pyrophoric ignition charge to initiate an ignition chain.

The ignition device is of simple and inexpensive construction and can be mechanically released by forces acting in a variety of directions. The device includes a cylindrical housing in which a percussion bolt and actuating lever are mounted one behind the other in axial alignment. A plurality of cup-shaped members, preferably a pair, are mounted in the housing so as to surround at least a portion of the actuating lever and percussion bolt. Upon actuation of the lever by applying a force thereto in a predetermined direction the cup-shaped members are spread apart against a biasing force to release the percussion bolt in the firing direction.

4 Claims, 11 Drawing Figures

IGNITION DEVICE

BACKGROUND OF THE INVENTION

The invention relates to an ignition device for mines, in particular training mines.

SUMMARY OF THE INVENTION

It is a general object of the invention to provide a universal ignition device for mines, in particular training mines.

Another object of the invention is to provide such a device with a simplified construction so that it is inexpensive to manufacture.

DETAILED DESCRIPTION

The invention relates to an ignition device in which a mechanically mounted percussion bolt is movably mounted. This percussion bolt can coact with, for example, a pyrotechnical charge. This charge in turn can coact with a smoke and/or sound signal emitting charge of a training mine.

The ignition device of the invention has the task of being universally applicable to different types of mines, in particular training mines, by applying to the ignition device differently oriented forces, for example pressure, tension, torsion and tilting forces. In particular when using the device with training mines an additional requirement exists, that is the ignition device must be as inexpensive as possible. This requirement is particularly advantageously met by means of the ignition device of the invention which device is nevertheless quite safe.

BRIEF DESCRIPTION OF THE DRAWING

Other advantages of the invention will become apparent from the following detailed description and drawing, in which.

DETAILED DESCRIPTION

Figure 1:
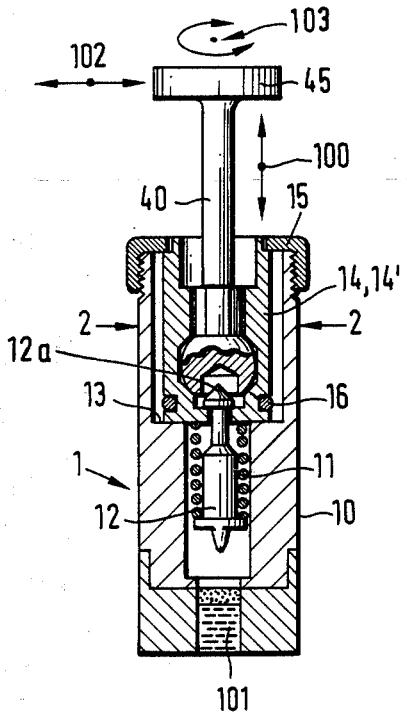
FIG. 1 is a cross-sectional elevational view of the ignition device of the invention.

Referring now to the drawing, FIG. 1 illustrates in longitudinal section a first embodiment of the ignition device 1. This device consists of a mechanically actuated portion to which, for example, a pyrotechnical charge is operatively connected. The mechanically actuated portion encompasses a substantially cylindrical housing 10 in which a percussion bolt 12, preloaded by a coil spring 11, is releasably mounted. A percussion bolt mounting means is formed by two halves 14, 14' divided by a diametrical plane. This percussion bolt mounting means is described in detail hereinafter. The percussion bolt mounting means can, however, be of more complex construction (see the embodiment of FIG. 6), but is at all times symmetrically divided. For example it may be divided into three, four or more parts.

Figure 3:
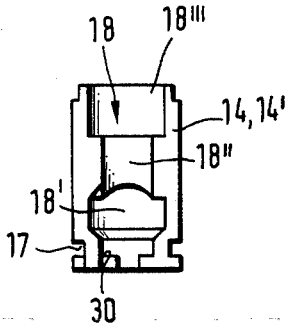
FIG. 3 is a side-elevational view of one part of a two-part percussion-bolt-holding device.
Figure 2:
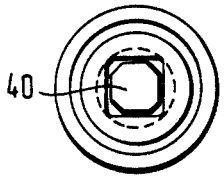
FIG. 2 is a cross-sectional view through the ignition device of FIG. 1 in the plane 2—2 of FIG. 1.
Figure 4:
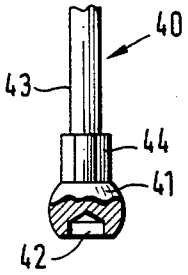
FIG. 4 is a side elevational view in which only the release lever of the ignition device of FIG. 1 is partially illustrated.
Figure 5:
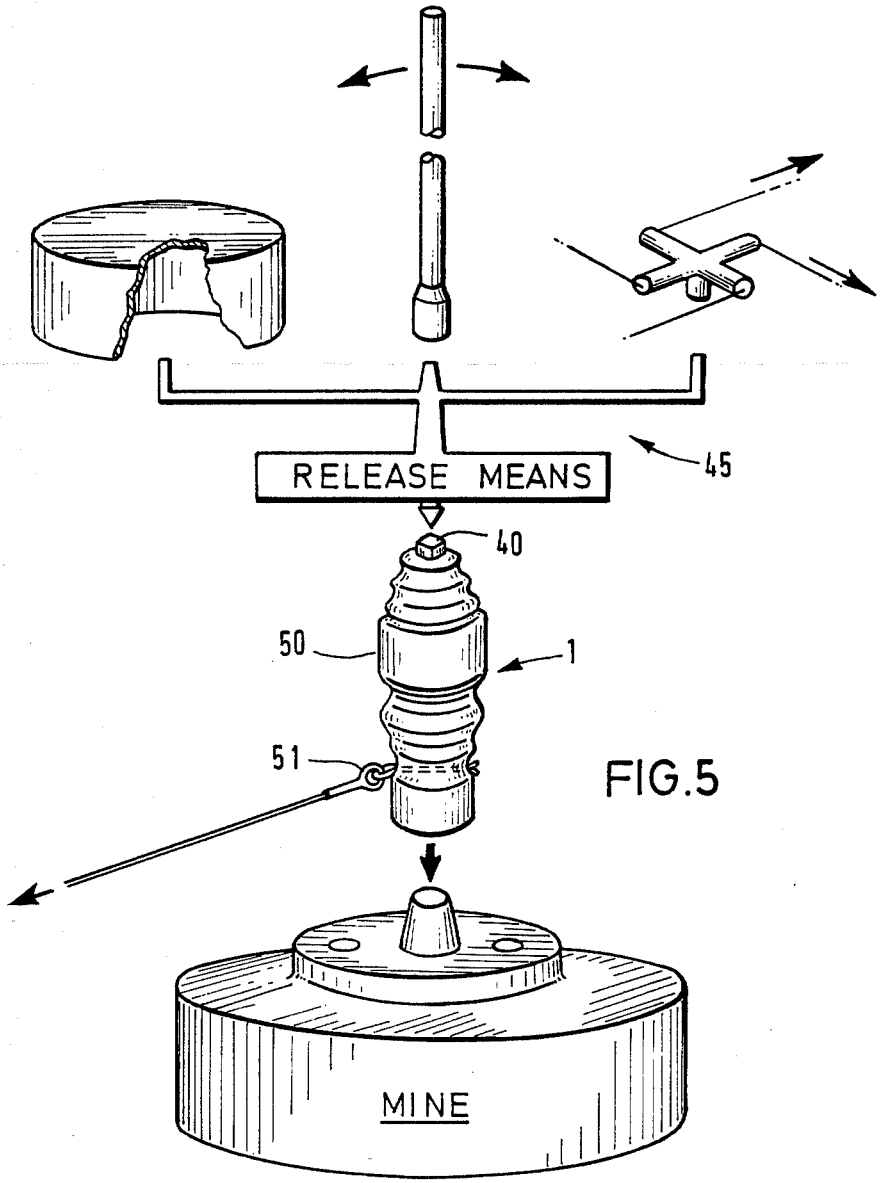
FIGS. 5 and 5A are explosive views in perspective of a training mine ignition system in which the ignition device of FIG. 1 is used for purposes of igniting the mine.
Figure 5A:
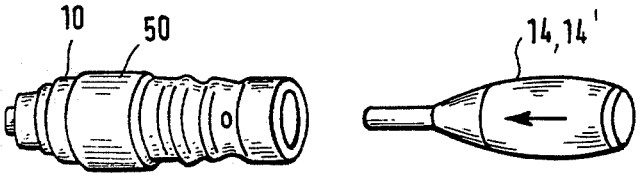

FIG. 3 is a side elevational view of one half of the percussion bolt mounting means, which mounting means is divided into two halves 14, 14'. The operation of the percussion bolt mounting means 14, 14' is covered by a cover 15 having a central bore in such a way that the mounting means, which are mounted within a central bore of the ignition device 1 are held therein by the threadably mounted cover 15 so that no motion in an axial or radial direction is possible. The bore narrows at stop 13 and thereby forms a partial base beneath the mounting means. The lower regions of the percussion bolt mounting means are pressed radially inwardly against each other by inwardly acting biasing means. Thereby the percussion bolt 12 is fixed, which bolt is acted on by the force of a coil spring 11 when in the inoperative position. The upper end of the percussion bolt 12 extends into a blind bore 42 of the actuating lever 40 and this percussion bolt 12 is held in an axial vertical position by means of a collar 30 formed at the lower end of the percussion bolt mounting means, which mounting means forms a cup-like recess into which the upper end of the percussion bolt 12 extends. In the embodiment of FIG. 1 the means for pressing together the two halves 14, 14' of the percussion bolt mounting means are formed, for example, by an O-ring 16, which is disposed within an annular recess 17 in the outer periphery of the percussion bolt mounting means 14, 14'. The O-ring 16 represents a particularly inexpensive but yet reliable biasing element. It is, of course, understood that other biasing means can be used with equal effectiveness, for example a ring spring can be used. Alternately, there can be used spring means for pressing together the two halves 14, 14' of the percussion bolt mounting means, such as for example coil springs, which bear against the inner wall of the cylindrical housing 10 with one end and against the corresponding percussion bolt mounting means half with the other end. However, when using such biasing means this leads to higher manufacturing costs. The percussion bolt mounting means form a composite central bore, respectively recess 18, the configuration of which can be clearly seen from the side elevational view of FIG. 3. The portion of bore, respectively recess 18, in the lower region of the percussion bolt mounting means 14, 14' has first a relatively reduced diameter, which then merges into a portion of the bore with a larger diameter. Thereby a collar 30 is formed on which the percussion bolt 12 with its head portion 12*a* abuts when in the inoperative position. The portion of the bore 18 of a larger diameter then merges into a recess 18' which, for example, is in the shape of a hollow sphere or ellipsoid. The recess 18' is followed by a bore 18'' having a cornered cross-section and this portion of the bore is then followed by a cylindrical bore portion 18''' of an enlarged diameter. In the bore, respectively recess, 18 there extends an actuating lever 40 which is partially illustrated, partially in cross-section, in FIG. 4. The actuating lever 40 includes a plurality of portions of different configuration, which will be described in detail hereinafter. In the lower region the actuating lever 40 is formed as a partially spherical portion 41 which matingly fits into the partially spherical bore portion 18'. The lever portion 41 and the corresponding bore portion 18' may also be ellipsoidally shaped. The lever portion 41 has a blind bore 42 in which the upper end 12*a* of the percussion bolt 12 projects via the collar 30. The spherically or ellipsoidally shaped lever portion 41 is adjoined by an hexagonally cornered region (in cross-section) 44 which in turn is adjoined by a cylindrical portion 43. The cylindrical portion 43 in turn ends, as can be seen from FIG. 1, in a disc 45 which is disposed in a plane that is normal to the longitudinal axis of the ignition device. When in an operatively mounted condition (FIG. 1) the spherically shaped portion 41 of the actuating lever 40 is arranged in the hollow spherically shaped recess 18', whereas the cornered region 44 of the actuating lever 40 is disposed in the bore portion 18'' having a cornered cross-section of the percussion bolt mounting means. In the illustrated embodiment the bore portion 18'' has a square cross-section, whereas the cornered region 44 of the actuating lever 40 has an octagonal shape. There is illustrated in FIG. 5 a training mine system which uses an ignition arrangement 1 in accordance with this invention.

Figure 6:
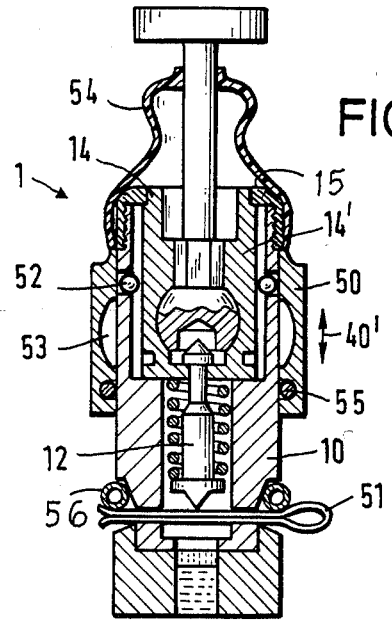
FIG. 6 is a side elevational cross-sectional view of an alternate version of the firing device of the invention which also can be used in conjunction with the training mine illustrated in FIG. 5 in which the firing device is provided two safety devices 50 and 51 which can also be seen in FIG. 5.
Figure 7:
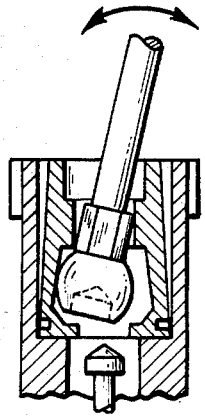
FIGS. 7 to 10 illustrate the manner of releasing the ignition device of the invention by means of applying different forces for actuating the lever thereof, which forces are illustrated by means of arrows in FIGS. 7 to 10.
Figure 8:
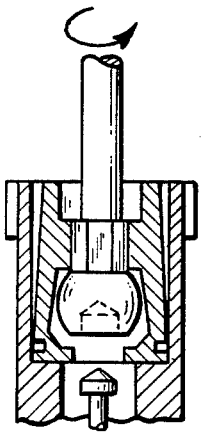
Figure 9:
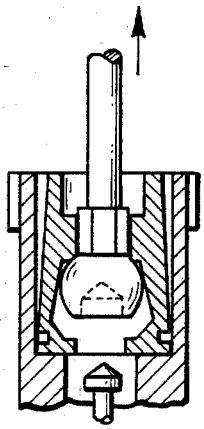
Figure 10:
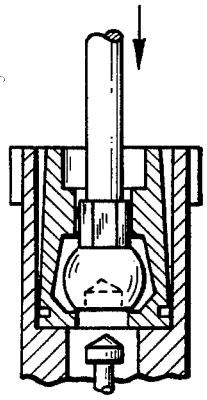

In FIG. 6 there is illustrated schematically in cross-section a slightly modified version of the ignition device of this invention forming part of a complete ignition device with two safety means 50 and 51. These safety means 50 and 51 are also illustrated in FIG. 5. The first safety means includes a ring 50, which is slidably movable between a safety position and an operative position as illustrated by the double-arrow 40' in FIG. 6. In the safety position the safety ring 50 is slid downwardly thereby pressing two balls 52, disposed in diametrically opposite bores of the housing 10, against the percussion bolt mounting means so that the latter cannot be radially moved outwardly. A rubber cuff 54 and an O-ring 55 seal the ignition device 1 against moisture. The second safety consists of a Cotter pin 51 which is inserted in a bore that extends transversely with respect to the longitudinal axis of the housing 10 and blocks the path of the percussion bolt 12 so that it cannot impinge on the pyrophoric detonating charge 101. In constrast to the heretofore known safety arrangement, the first safety device 50 makes possible a later re-arming and thereby re-use of a first disarmed ignition device. The ring 50 can be simply slid into the safety position to disarm the device. FIGS. 7 to 10 illustrate the various motions that can be imparted on the actuating lever 40 in order to release the ignition device. These various motions are illustrated by arrows at the top of the actuating lever 40.

The aforedescribed embodiments of the ignition device of this invention are universally applicable to different types of mines, in particular training mines. They comprise only a small number of parts which are simply and inexpensively constructed. Thereby it is possible to manufacture a very inexpensive ignition device. The pyrotechnical ignition means are not in all cases necessary. An electric, optical or acoustic indication of the mine function, after release of the ignition device, is also realizable in other ways.

MANNER OF OPERATION

The ignition device of this invention operates as follows:

By applying pressure or pull on the actuating lever 40 there is pushed, by applying a force in one of two directions illustrated by the double-arrow 100 (FIG. 1), the exterior peripheral surface of the spherically shaped lever portion 41 of the actuating lever 40 against the inner wall of the hollow spherically shaped bore portion 18' and presses thereby apart from each other the two halves 14, 14' of the percussion bolt mounting means which are held together by the O-ring 16 in the lower region thereof. This has as a consequence that first the collar on the percussion bolt head portion 12*a* which rests against the collar 30 is released and the percussion bolt 12 under the action of the thereby released coil spring 11 is propelled in the direction of the pyrotechnical ignition means 101. The release of the percussion bolt 12 can also be effected by means of a tilting motion at any one of randomly selected directions, which motion is illustrated schematically by the double arrow 102 in FIG. 1 and by the double arrow in FIG. 7. Finally, a torsional motion, illustrated by means of the double-arrow 103 (FIG. 1 and in FIG. 8) can be imparted onto the actuating lever 40, which force is applied preferably tangentially via the disc 45 and which leads to a release of the percussion bolt 12. This is effected by virtue of the fact that in the interior of the cornered bore portion 18'' the cornered lever portion 44 of the actuating lever 40, which is rotated about the longitudinal axis thereof, applies a force against the wall of this bore portion 18'' which causes the halves 14, 14' of the percussion bolt mounting means to be spread apart.

Although a limited number of embodiments of the invention have been illustrated in the accompanying drawings and described in the foregoing specification, it is to be especially understood that various changes, such as in the relative dimensions of the parts, materials used, and the like, as well as the suggested manner of use of the apparatus of the invention, may be made therein without departing from the spirit and scope of the invention, as will now be apparent to those skilled in the art.

I claim:

1. Ignition device for mines, in particular training mines, comprising a cylindrical housing having a central axis, said housing having an inside surface with stop defined on said inside surface;

a percussion bolt;

an actuating lever, said actuating lever and said percussion bolt disposed successively along said central axis inside said housing;

percussion bolt mounting means formed by clamp arms having an upper section and a lower section, said mounting means define a bore disposed along said central axis, said mounting means commonly surrounding at least part of the axial extent of said percussion bolt and said actuating lever;

a cover for said housing, said cover defining a bore along said central axis, said upper section of said clamp arms is fixed by said cover and cooperating with said stop so as to prevent movement in an axial direction and in an outward radial direction;

biasing means, said biasing means acting radially inwardly to press together said lower section of said clamp arms, thereby forming in said upper section of said clamp arms a swivel point relative between said clamp arms and said actuating lever;

said bore of said precussion bolt mounting means includes a first portion, said first portion being rotation-symmetrical in a horizontal plane, and conically tapered upwardly and downardly in a vertical direction;

a second portion of said bore of said percussion bolt mounting means adjoins said first portion of said bore of said percussion bolt mounting means, said second portion displays a cornered horizontal cross-section;

a third portion of said bore of said percussion bolt mounting means adjoins said second portion of said bore of said percussion bolt mounting means, said third portion being cylindrical;

said actuating lever includes a first portion, said first portion of said actuating lever is shape-adapted to said first portion of said bore of said percussion bolt mounting means;

a cornered portion of said actuating lever adjoins said first portion of said actuating lever, said cornered portion is shape-adapted to said second portion of said bore of said percussion bolt mounting means; and a third portion of said actuating lever adjoins said cornered portion of said actuating lever, said third portion of said actuating lever is cylindrical and displays a diameter smaller than the diameter of said third portion of said bore of said percussion bolt mounting means.

2. The improved ignition device as set forth in claim 1, wherein said biasing means are in the form of a first O-ring and said two clamp arms defining jointly an annular recess in their respective lower regions, said O-ring being mounted in said annular recess.

3. The improved ignition device as set forth in claim 1, wherein said housing has a pair of diametrically opposite bores, a pair of balls respectively movably mounted in said pair of opposite bores, a cylindrical sleeve having an internal diameter which is slightly larger than the external diameter of said housing and having an annular internal recess, said sleeve being axially slidably movably mounted on said housing between a safety position and an operative position, whereby when said sleeve is in its safety position the internal walls of the sleeve bias the pair of balls against the external peripheral surface of the two clamp arms so as to prevent them from moving apart.

4. The improved ignition device as set forth in claim 1, including a Cotter pin diametrically removably mounted through said housing below said percussion bolt so as to block its path when it is released by said two clamp arms of said percussion bolt mounting means.

* * * * *